US005890309A

United States Patent [19]

Markarian

[11] Patent Number: 5,890,309

[45] Date of Patent: Apr. 6, 1999

[54] PIVOTING PICTURE FRAMES

[76] Inventor: Jean Markarian, 2416 Baggett Dr., Santa Rosa, Calif. 95401

[21] Appl. No.: 990,690

[22] Filed: Dec. 15, 1997

[51] Int. Cl.[6] ..... G09F 1/12

[52] U.S. Cl. ..... 40/733; 40/605

[58] Field of Search ..... 40/729, 733, 747, 40/605; D6/300, 301; 248/442.2

[56] References Cited

U.S. PATENT DOCUMENTS

| | | | |
|---|---|---|---|
| 2,409,814 | 10/1946 | Vargish | 40/474 |
| 2,434,860 | 1/1948 | Oxley | 40/745 X |
| 3,203,124 | 8/1965 | Stoessel | 40/605 |
| 3,817,396 | 6/1974 | Markson | 40/605 X |
| 5,009,382 | 4/1991 | Huffaker et al. | 248/442.2 X |
| 5,505,421 | 4/1996 | Marthaler | 248/442.2 |
| 5,678,792 | 10/1997 | Arguin et al. | 248/442.2 X |
| 5,697,594 | 12/1997 | Adams et al. | 248/442.2 |

*Primary Examiner*—Joanne Silbermann

[57] ABSTRACT

A pair of pivoting picture frames each include a vertical picture holder and a horizontal stand. A horizontal hinge is attached between adjacent edges of the horizontal stands, so that the frames are pivotable relative to each other about a horizontal axis generally perpendicular to the picture holders. The frames can be positioned around a corner of a computer monitor by pivoting them to form a right angle, or they can be positioned on top of the monitor, or on furniture, by pivoting them so that they are aligned.

1 Claim, 1 Drawing Sheet

PIVOTING PICTURE FRAMES

BACKGROUND OF THE INVENTION

1. Field Of The Invention:

This invention relates generally to picture frames.

2. Prior Art:

A typical desktop picture frame includes a leg on the back for propping up the frame. Some frames are provided as a pair connected by a vertical hinge between their adjacent vertical sides, so that when they are angled relative to each other, they can stand up without a leg. Other frames are made by bending a single sheet of acrylic into an "L" shape so as to provide an integral stand. However, no prior art picture frame can be conveniently attached to a corner of a computer monitor, and can also be attached to a top or side thereof.

OBJECTS OF THE INVENTION

Accordingly, objects of the present pivoting picture frames are:

to be easily and stably positioned around a corner of a computer monitor;

to be easily and stably positioned on top of a computer monitor; and to be positionable on top of furniture.

Further objects of the present invention will become apparent from a consideration of the drawings and ensuing description.

BRIEF SUMMARY OF THE INVENTION

A pair of pivoting picture frames each include a vertical picture holder and a horizontal stand. A horizontal hinge is attached between adjacent edges of the horizontal stands, so that the frames are pivotable relative to each other about a horizontal axis while remaining generally coplanar. The frames can be positioned around a corner of a computer monitor by pivoting them to form a right angle, or they can be positioned on top of the monitor, or on furniture, by pivoting them so that they are aligned.

Figure 1:
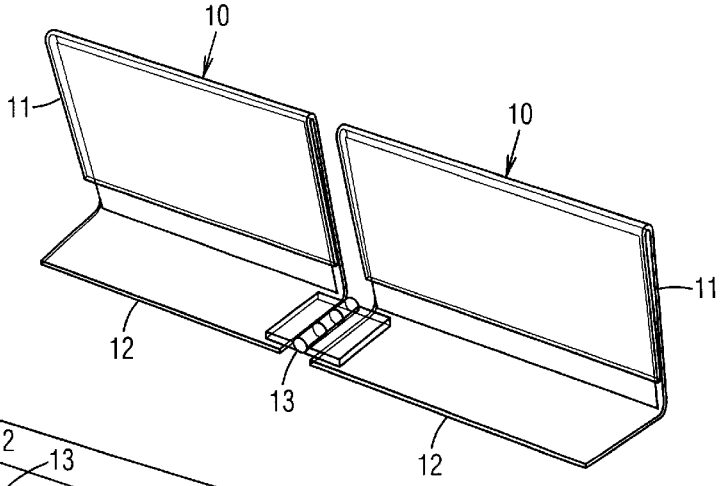
FIG. 1 is a rear perspective view of the present pivoting picture frames.

| DRAWING REFERENCE NUMERALS | |
|---|---|
| 10. Picture Frames | 11. Picture Holders |
| 12. Stands | 13. Hinge |
| 14. Computer Monitor | |

DETAILED DESCRIPTION OF THE INVENTION

A preferred embodiment of the invention is shown in the rear perspective view in FIG. 1. It includes a pair of laterally positioned picture frames 10 each comprising a generally vertical picture holder 11 and a horizontal stand 12 attached to a lower edge thereof. A hinge 13 is connected between adjacent edges of stands 12, i.e., adjacent lower corners of frames 10. The axis of hinge 13 is horizontal, and generally perpendicular to the planes of picture holders 11, so that frames 10 can be pivoted relative to each other while remaining generally coplanar. In this example, picture frames 10 are made of bent clear acrylic sheets, but they may be of a variety of other constructions. Hinge 13 is preferably a clear acrylic hinge, but any other type of hinge may be used.

Figure 2:
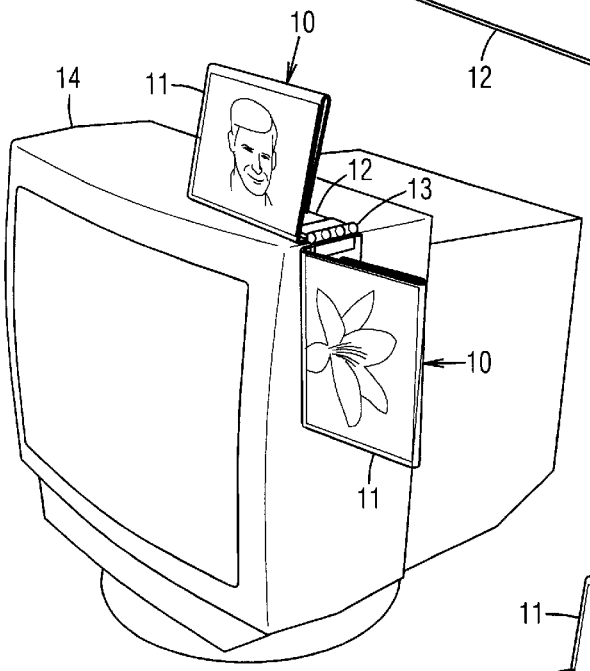
FIG. 2 is a side perspective view of the pivoting picture frames positioned around a corner of a computer monitor.
Figure 3:
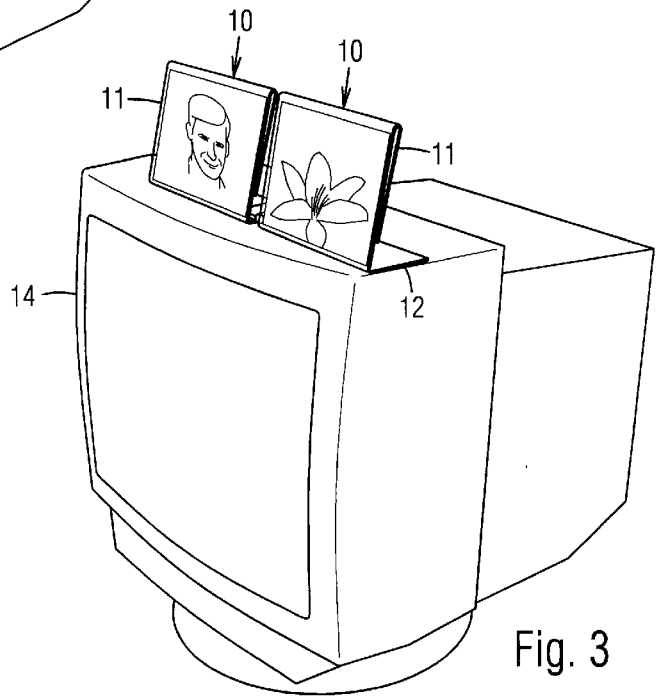
FIG. 3 is a side perspective view of the pivoting picture frames positioned on top of the computer monitor.

As shown in the side perspective view in FIG. 2, picture frames 10 may be pivoted so that their lower edges form a right angle, and conveniently positioned around a corner of a computer monitor 14. Because frames 10 are connected, no adhesive or other type of fastener is necessary for positioning them on monitor 14. Alternatively, they can be pivoted so that their lower edges are aligned with each other, and positioned on top of monitor 15, as shown in FIG. 3. They can also be positioned on furniture, such as a desk, a shelf, etc (not shown).

SUMMARY AND SCOPE

Accordingly, a pair of pivoting picture frames has been provided. They can be conveniently positioned around a corner of a computer monitor. They can also be easily positioned on top of the monitor, or on furniture.

Although the above description is specific, it should not be considered as a limitation on the scope of the invention, but only as an example of the preferred embodiment. Many substitutes and variations are possible within the teachings of the invention. For example, the frames can be positioned on a television. Three or more frames can be hinged together in a series. Therefore, the scope of the invention should be determined by the appended claims and their legal equivalents, not by the examples given.

I claim:

1. A picture frame device, comprising:

a pair of laterally positioned picture frames each including a generally vertical picture holder defining a picture holding plane and a generally horizontal stand attached to a bottom edge of said picture holder, each stand including a rear edge and two side edges, wherein one of said side edges of one of said stands is adjacent one of said side edges of the other of said stands; and a hinge connecting said adjacent side edges of said stands, said hinge having a longitudinal axis generally perpendicular to said planes of said picture holders, whereby said picture frames are pivotable about said hinge relative to each other while remaining generally coplanar; said picture frames being pivotable to a first position such that the bottom edges thereof are aligned with each other for engaging a straight supporting surface, and said picture frames further being pivotable to a second position such that said bottom edges are angled relative to each other for engaging around a corner of a plurality of supporting surfaces which meet at an angle.

* * * * *